US010192536B1

(12) United States Patent
Jia

(10) Patent No.: US 10,192,536 B1
(45) Date of Patent: Jan. 29, 2019

(54) PEDAL BOARD AND SOUND EFFECT ADJUSTING DEVICE USING SAME

(71) Applicant: SWIFF TECHNOLOGY CO., LTD., Shenzhen, Guangdong (CN)

(72) Inventor: He Jia, Guangdong (CN)

(73) Assignee: SWIFF TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/893,674

(22) Filed: Feb. 11, 2018

(30) Foreign Application Priority Data

Feb. 5, 2018 (CN) ..... 2018 2 0218070 U

(51) Int. Cl.
*G10H 1/34* (2006.01)
*G10H 1/00* (2006.01)

(52) U.S. Cl.
CPC ..... *G10H 1/348* (2013.01); *G10H 1/0008* (2013.01)

(58) Field of Classification Search
CPC ..... G10H 1/348; G10H 1/0008
USPC ..... 84/746
See application file for complete search history.

(56) References Cited

U.S. PATENT DOCUMENTS 4,429,604 A * 2/1984 Eck ..... G10H 1/36 84/655
5,565,641 A * 10/1996 Gruenbaum ..... G10H 1/0066 84/451
7,005,571 B1 * 2/2006 Groff ..... G10H 1/0066 84/615
9,659,553 B1 * 5/2017 Lawrence ..... G10H 1/348
9,728,172 B1 * 8/2017 Perez ..... G10H 1/18
9,966,053 B2 * 5/2018 Mayo ..... G10H 1/348
2011/0303077 A1 * 12/2011 Vinciguerra ..... G10H 1/0091 84/746
2014/0126609 A1 * 5/2014 Vumbaco ..... G10H 1/34 375/130
2016/0293151 A1 * 10/2016 Mayo ..... G10H 1/0058
2017/0316766 A1 * 11/2017 Perez ..... G10H 1/18
2018/0090115 A1 * 3/2018 Skillings ..... G10H 1/348
2018/0144731 A1 * 5/2018 McHale ..... G10H 1/348
2018/0151162 A1 * 5/2018 McKenzie ..... G10H 1/348

* cited by examiner

*Primary Examiner* — David Warren

(57) ABSTRACT

A sound effect adjusting device includes: an effect pedal; a pedal board including a first housing, a three-way toggle switch, a microswitch, and a mounting member; the first housing including an input interface, an output interface, a send interface and a return interface formed thereon; the three-way toggle switch having a first contact blade electrically connected with the input interface, a second contact blade electrically connected with the send interface, a third contact blade electrically connected with the microswitch; the mounting member having a first pins assembly electrically coupled to the effect pedal; while the effect pedal assembled with the pedal board, the microswitch is off, and operates the three-way toggle switch so that the effect pedal is connected between the input interface and the output interface in series, or, the effect pedal connected between the send interface and the return interface in series.

17 Claims, 11 Drawing Sheets

PEDAL BOARD AND SOUND EFFECT ADJUSTING DEVICE USING SAME

CROSS REFERENCE TO RELATED APPLICATION

This application claims the benefit of Chinese Application No. 201820218070.8, filed on Feb. 5, 2018, the content of which are incorporated by reference herein in its entirety for all purposes.

TECHNICAL FIELD

The present disclosure relates to a sound effect adjusting device, and more particularly to a music effect pedal board used by a guitar or other stringed instruments artists.

BACKGROUND ART

In order to obtain various sound effects while artists playing music instruments, such as delay, distortion, etc., to satisfy audience's three-dimensional music enjoyment, an effect pedal is invented for adjusting the sound effects of the music instrument.

The effect pedal is usually connected with the musical instrument in series. However, multiple effect pedals also can be connected with each other in parallel. With such configuration, signal is split into different channels, for example, into two channels, one channel is processed, and the other channel is not. The resulting different channels are combined back together to produce the final output signal, which is sent to a speaker to be transformed into an audible sound.

However, the following drawbacks existed in the above-mentioned effect pedals with such construction: an signal input interface of the effect pedal is electrically connected with an signal input interface of the pedal board via cable; an signal output interface of the effect pedal is electrically connected with a signal output interface of the pedal board via cable; thus, the cables would be arranged messy. Furthermore, when users need to reduce or replace one or more effect pedals, they need to remove the effect pedal(s), and/or mounting another effect pedal onto the pedal board, thus, it is cumbersome and time-consuming to change different effect pedals.

SUMMARY

In one aspect of the disclosure, a sound effect adjusting device, comprises: an effect pedal including a second pins assembly; a pedal board including a first housing, a three-way toggle switch mounted in the first housing, a microswitch mounted in the first housing and electrically connected with the three-way toggle switch, and a mounting member mounted on the first housing to attach to the effect pedal; wherein, the first housing includes an input interface, an output interface, a send interface and a return interface formed thereon; the three-way toggle switch has a first contact blade electrically connected with the input interface, a second contact blade electrically connected with the send interface, and a third contact blade electrically connected with the microswitch; the mounting member has a first pins assembly electrically coupled to the second pins assembly and removable attached to the second pins assembly; wherein, while the effect pedal assembled with the pedal board, the microswitch is off, and actuates the three-way toggle switch so that the effect pedal is connected between the input interface and the output interface in series, or, the effect pedal is connected between the send interface and the return interface in series.

In one embodiment, the first pins assembly includes a first positive pin, a first negative pin, a first signal input pin and a first signal output pin; the second pins assembly includes a second positive pin, a second negative pin, a second signal input pin and a second signal output pin; the second positive pin inserts into the first positive pin, the second negative pin inserts into the first negative pin, the second signal input pin inserts into the first signal input pin, and the second signal output pin inserts into the first signal output pin.

In one embodiment, the first contact blade is switched to electrically connect with the second pins assembly via the first pins assembly and the third contact blade is synchronously switched to electrically connect with the output interface so that the effect pedal is connected between the input interface and the output interface in series.

In one embodiment, the second contact blade is switched to electrically connect with the second pins assembly via the first pins assembly and the third contact blade is synchronously switched to electrically connect with the return interface so that the effect pedal is connected between the send interface and the return interface in series.

In one embodiment, the mounting member further includes a U-shaped panel having a flat panel attached to the effect pedal and a side panel extending upward from the edge of the flat panel; and the first pins assembly fixed on the flat panel.

In one embodiment, the mounting member further includes a first projection protruding toward the effect pedal for fixing the first pins assembly and a first through hole formed in the flat panel and adjacent to the first projection.

In one embodiment, the flat panel is made by magnetic material.

In one embodiment, the mounting member further includes at least one magnet disposed on the flat panel.

In one embodiment, the microswitch includes a fixing body fixed to the first housing, an elastic plate having a fixing end fixed to the fixing body and a flexible end, a movable column movably contacted with the flexible end, a reset spring sleeved outside the movable column, a carrying plate located above the fixing body for carrying the reset spring, and a stop ring located upon the reset spring and sleeved outside the movable column, wherein, the movable column movably passes through the carrying plate and extending out of the flat panel via the first through hole.

In another aspect of the disclosure, a pedal board, assembled with an effect pedal, comprises: a first housing, includes an input interface, an output interface, a send interface and a return interface formed thereon; a three-way toggle switch mounted in the first housing, the three-way toggle switch has a first contact blade electrically connected with the input interface, a second contact blade electrically connected with the send interface, and a third contact blade; a microswitch mounted in the first housing and electrically connected with the third contact blade of the three-way toggle switch; and a mounting member mounted on the first housing to removable attach to the effect pedal, the mounting member has a first pins assembly electrically coupled to the effect pedal and removable attached to the effect pedal; wherein, while the effect pedal assembled with the pedal board, the microswitch is off, and actuates the three-way toggle switch so that the effect pedal is connected between the input interface and the output interface in series, or, the effect pedal is connected between the send interface and the return interface in series.

In one embodiment, the first contact blade is switched to electrically connect with the second pins assembly via the first pins assembly and the third contact blade is synchronously switched to electrically connect with the output interface so that the effect pedal is connected between the input interface and the output interface in series.

In one embodiment, the second contact blade is switched to electrically connect with the second pins assembly via the first pins assembly and the third contact blade is synchronously switched to electrically connect with the return interface so that the effect pedal is connected between the send interface and the return interface in series.

In one embodiment, the mounting member further includes a U-shaped panel having a flat panel attached to the effect pedal and a side panel extending upward from the edge of the flat panel; and the first pins assembly fixed on the flat panel.

In one embodiment, the mounting member further includes a first projection protruding toward the effect pedal for fixing the first pins assembly and a first through hole formed in the flat panel and adjacent to the first projection.

In one embodiment, the flat panel is made by magnetic material.

In one embodiment, the mounting member further includes at least one magnet disposed on the flat panel.

In one embodiment, the microswitch includes a fixing body fixed to the first housing, an elastic plate having a fixing end fixed to the fixing body and a flexible end, a movable column movably contacted with the flexible end, a reset spring sleeved outside the movable column, a carrying plate located above the fixing body for carrying the reset spring, and a stop ring located upon the reset spring and sleeved outside the movable column, wherein, the movable column movably passes through the carrying plate and extending out of the flat panel via the first through hole.

BRIEF DESCRIPTION OF THE DRAWINGS

The above and/or additional objects, features and advantages of the present disclosure, will be further elucidated by the following illustrative and non-limiting detailed description of embodiment of the present disclosure, with reference to the appended drawings, wherein:

FIG. 12 shows a diagram of a circuit used in the sound effect adjusting device shown in FIG. 1.

DESCRIPTION OF THE PREFERRED EMBODIMENTS

The present invention will be further illustrated below with reference to the attached drawings and the embodiments.

Figure 1:
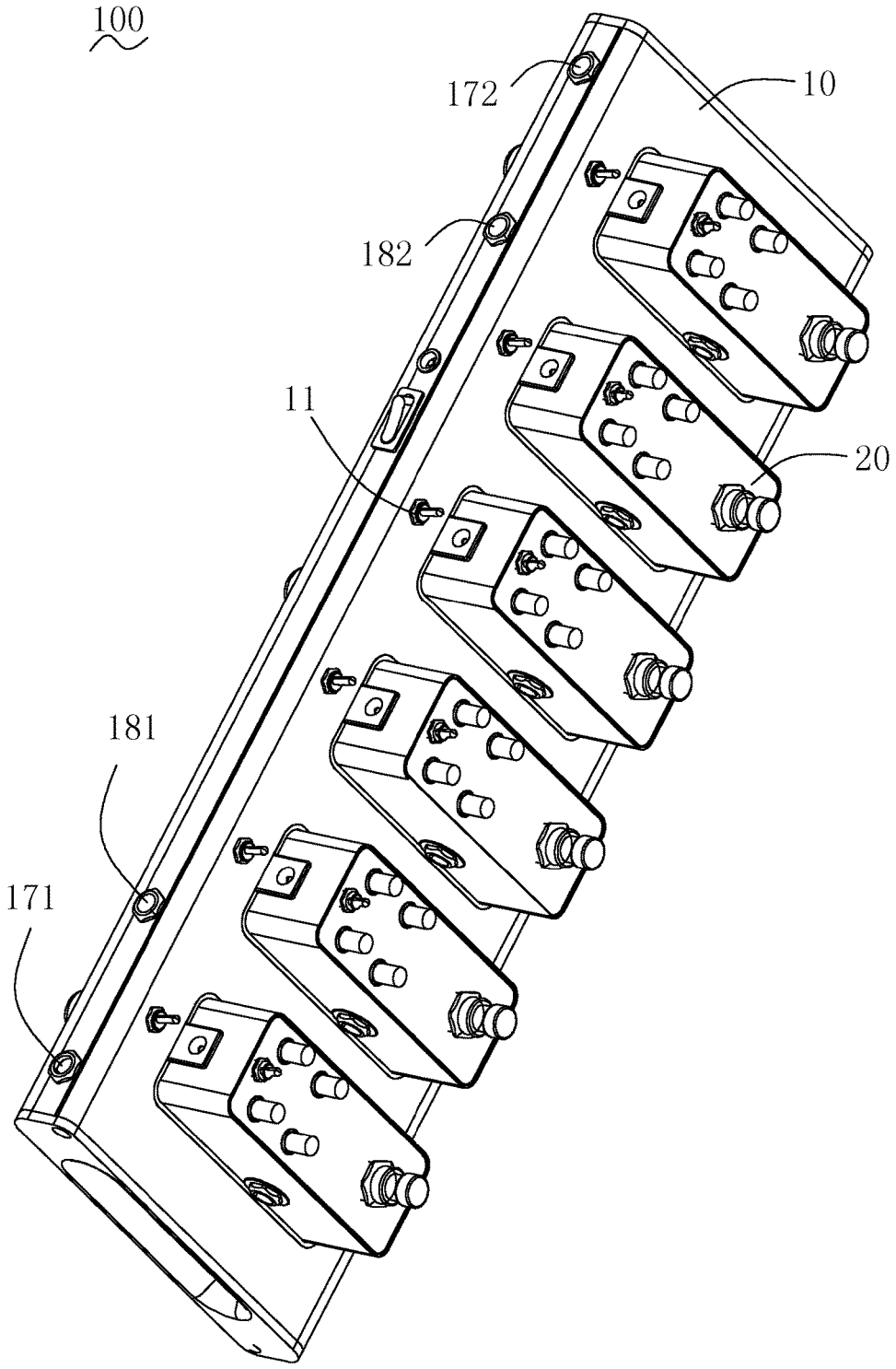
FIG. 1 is a perspective view of a sound effect adjusting device according to one embodiment of the present disclosure.
Figure 2:
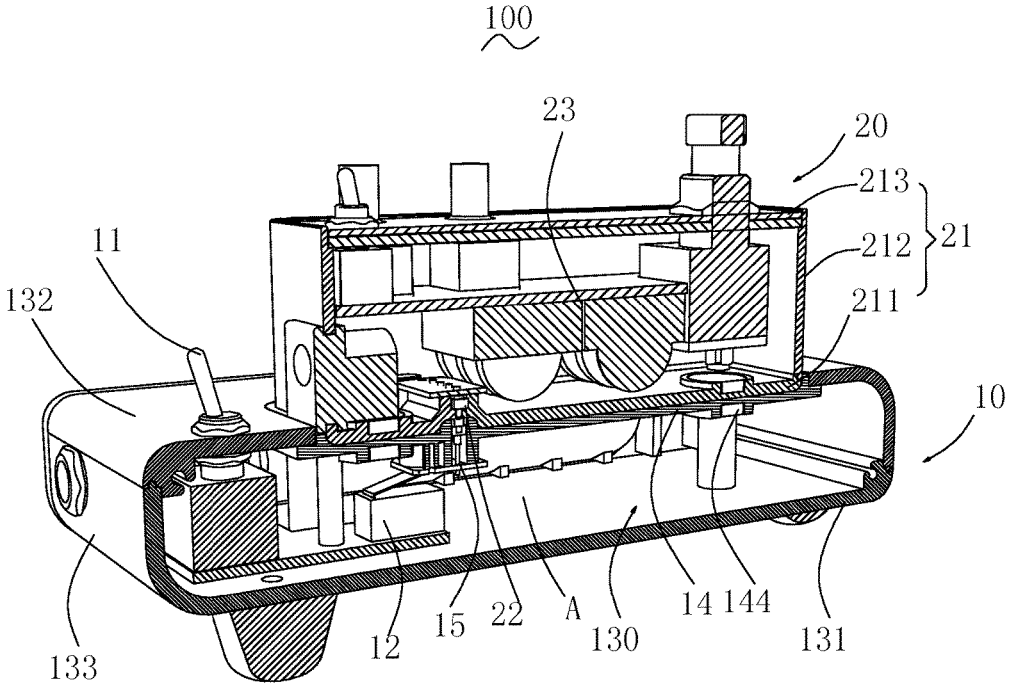
FIG. 2 is a cross-sectional view of the sound effect adjusting device shown in FIG. 1.
Figure 3:
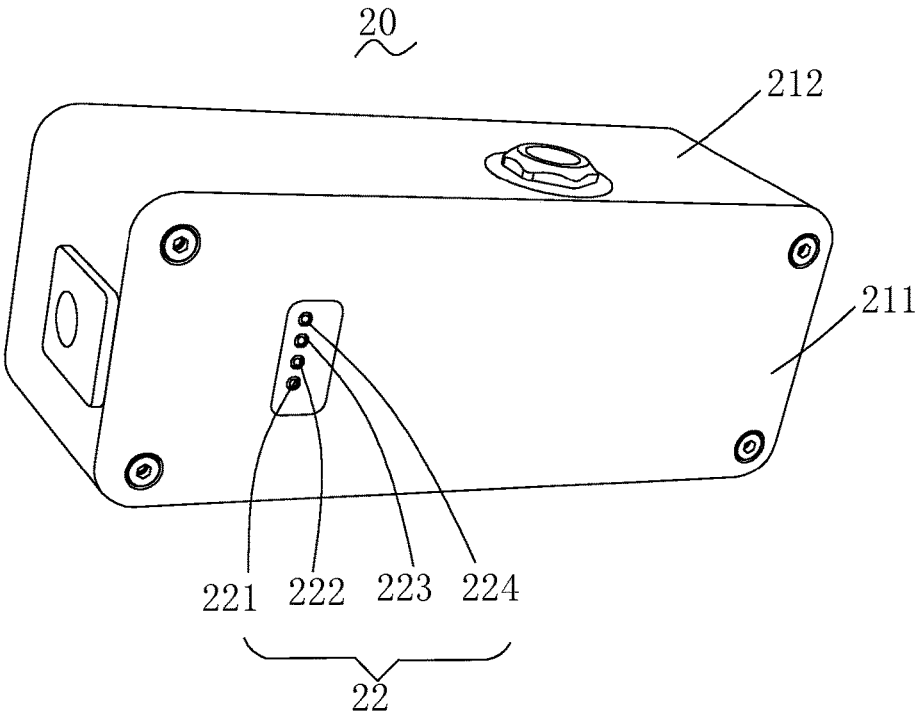
FIG. 3 is a perspective view of an effect pedal of the sound effect adjusting device shown in FIG. 1.
Figure 4:
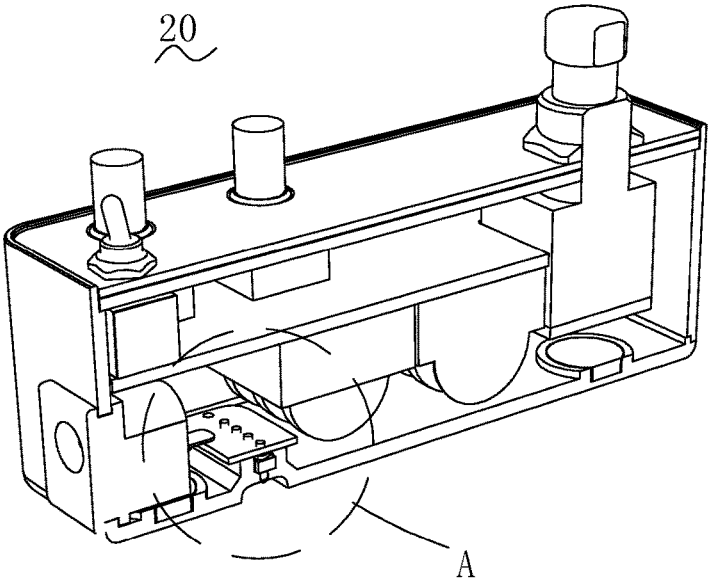
FIG. 4 is a cross-sectional view of the effect pedal shown in FIG. 3.
Figure 5:
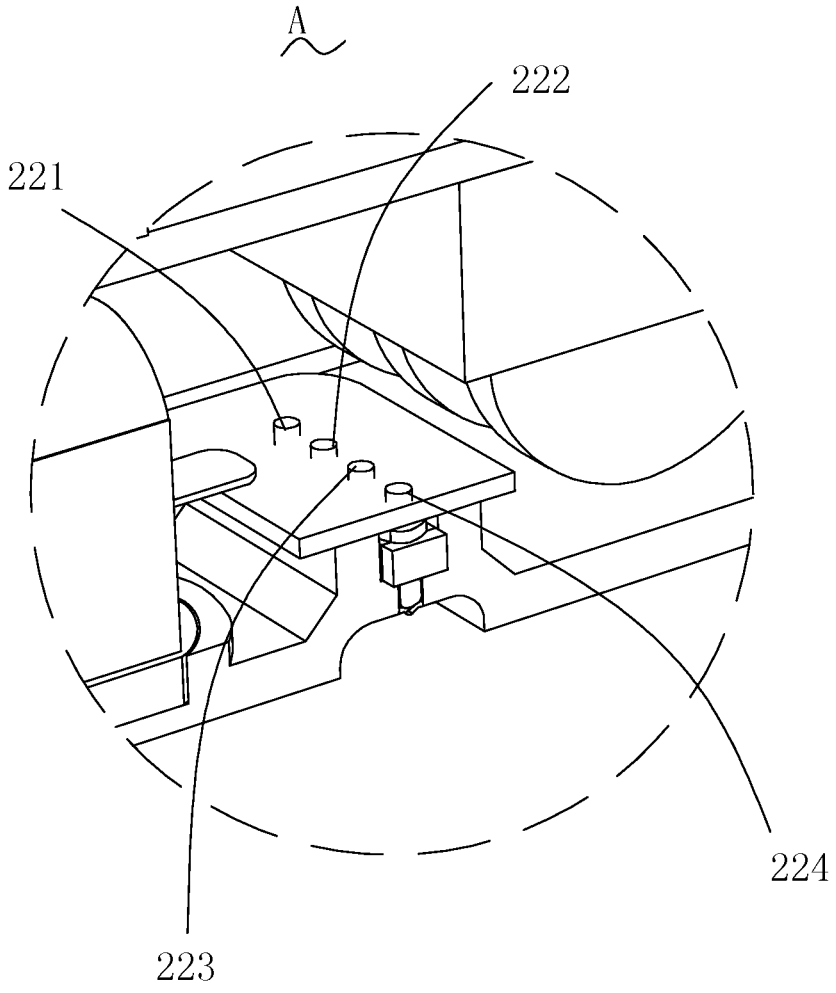
FIG. 5 is an enlarged view of part A in FIG. 4.
Figure 6:
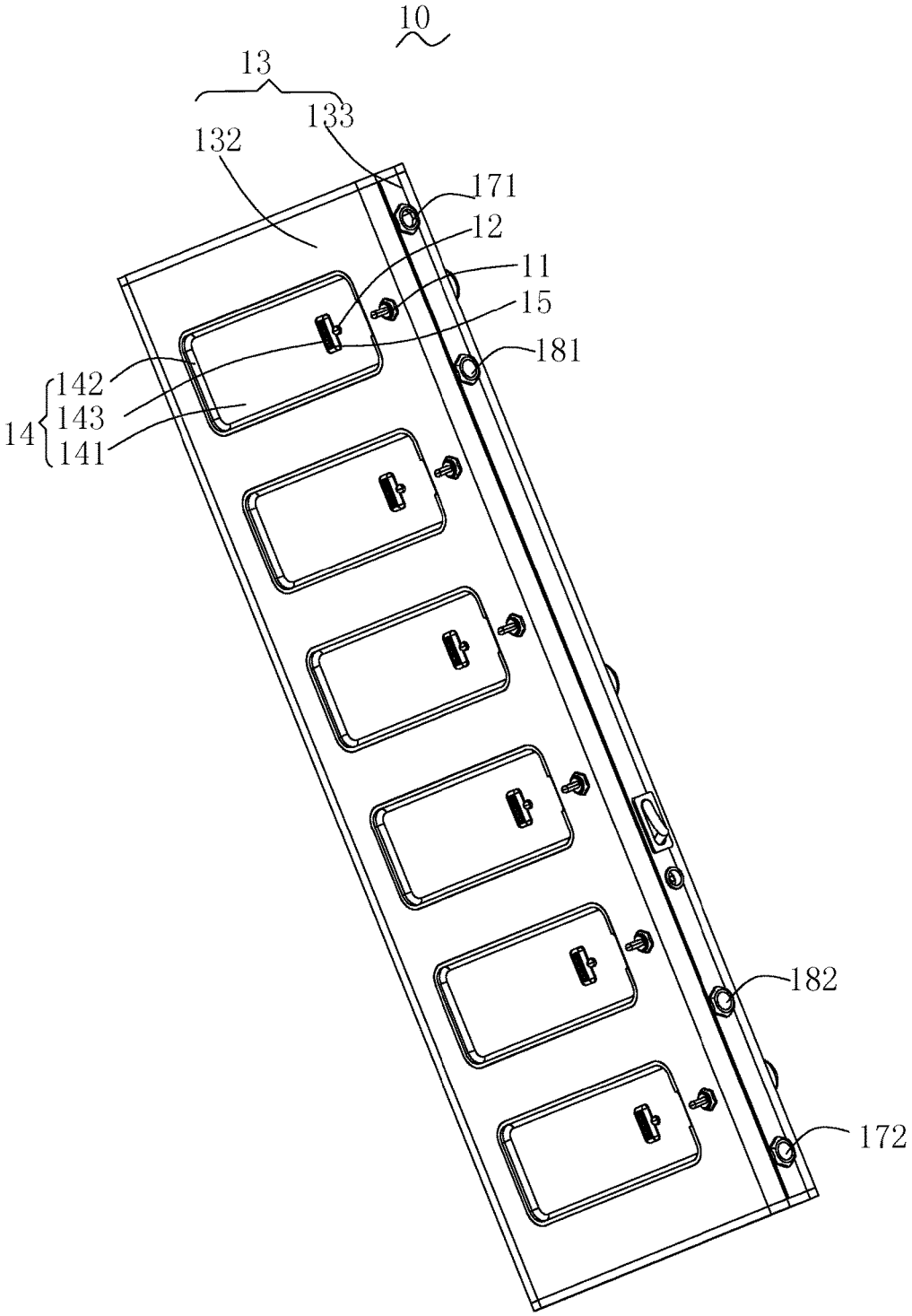
FIG. 6 is a perspective view of a pedal board of the sound effect adjusting device shown in FIG. 1.
Figure 7:
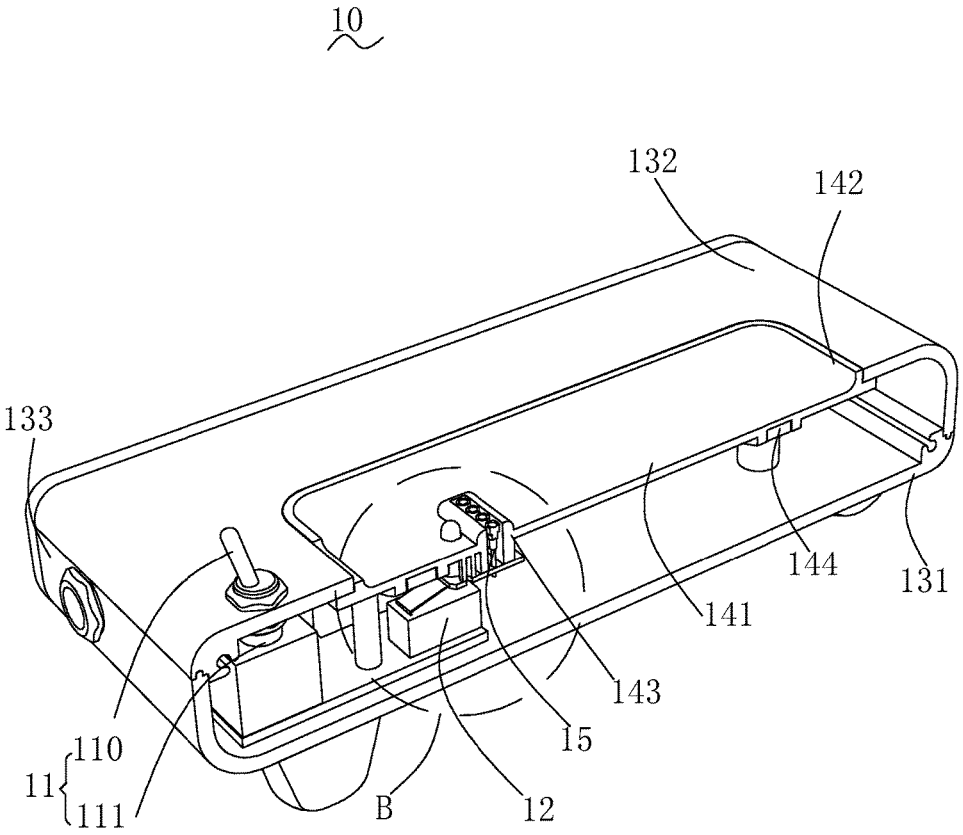
FIG. 7 is a cross-sectional view of the pedal board shown in FIG. 6.
Figure 8:
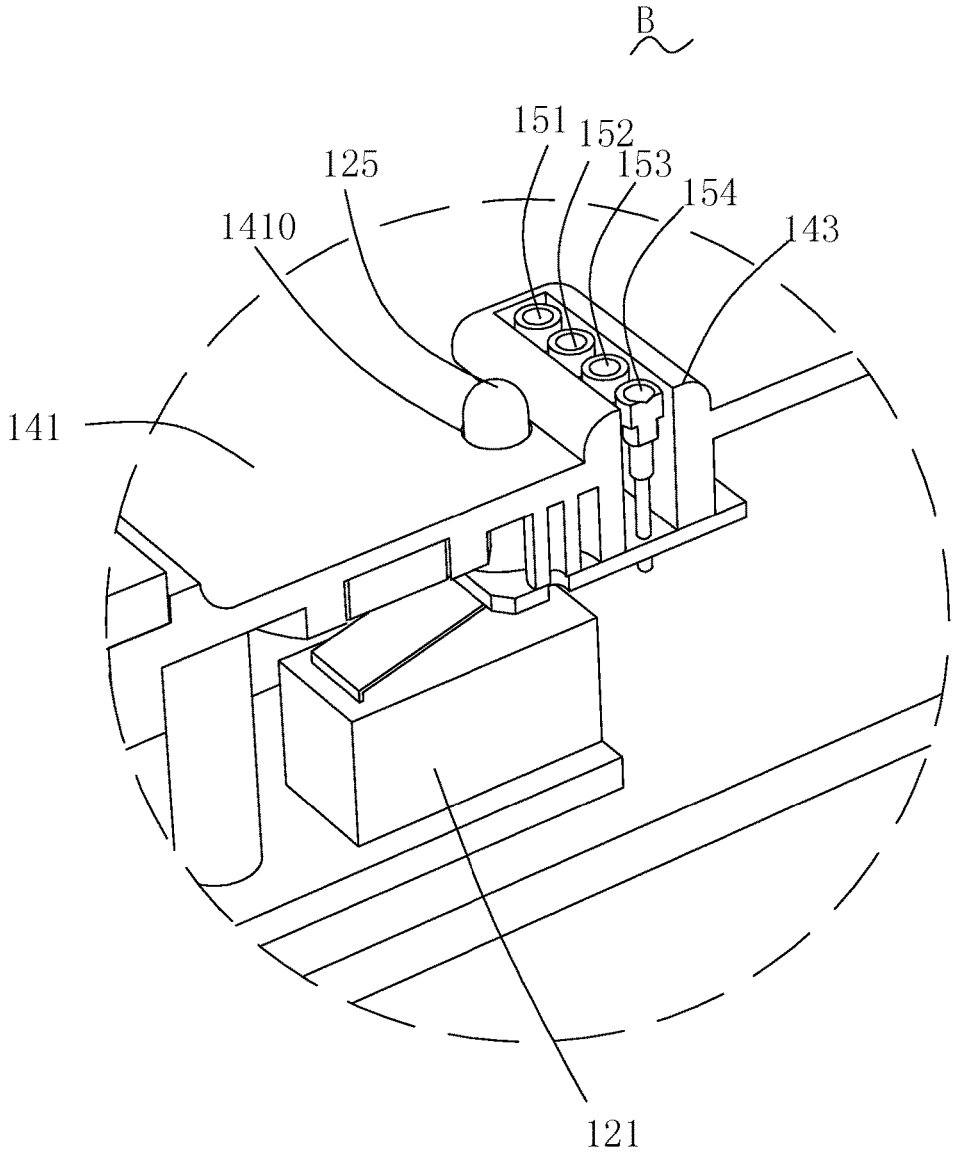
FIG. 8 is an enlarged view of part B in FIG. 7.
Figure 9:
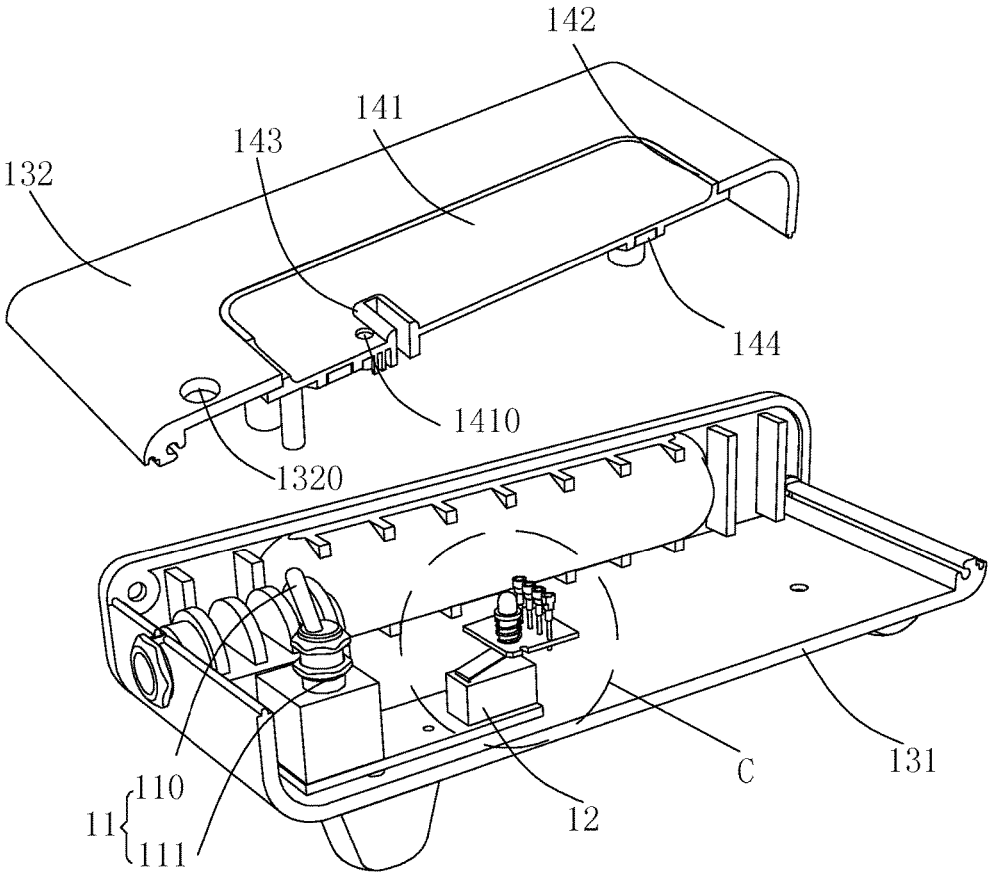
FIG. 9 is an exploded view of the pedal board shown in FIG. 7.
Figure 10:
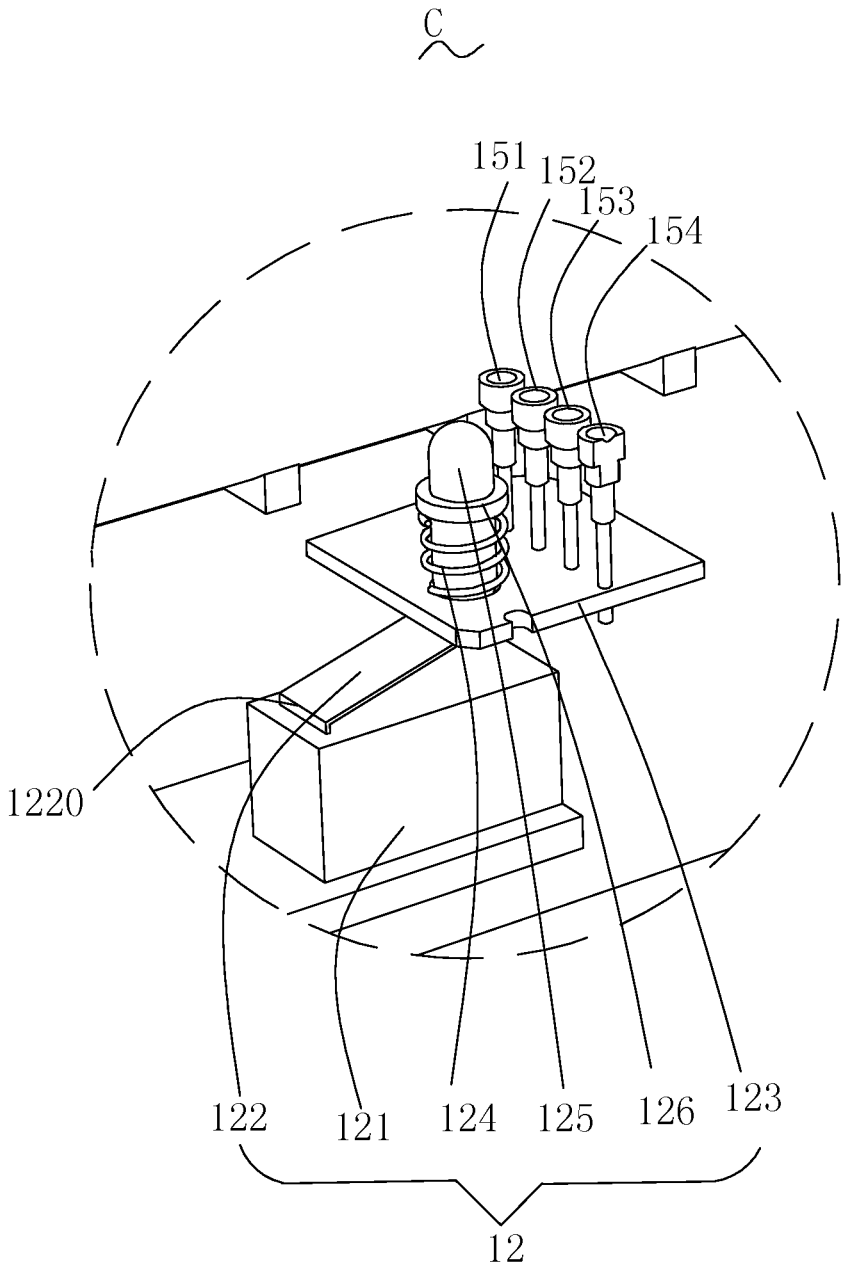
FIG. 10 is an enlarged view of part C in FIG. 9.
Figure 11:
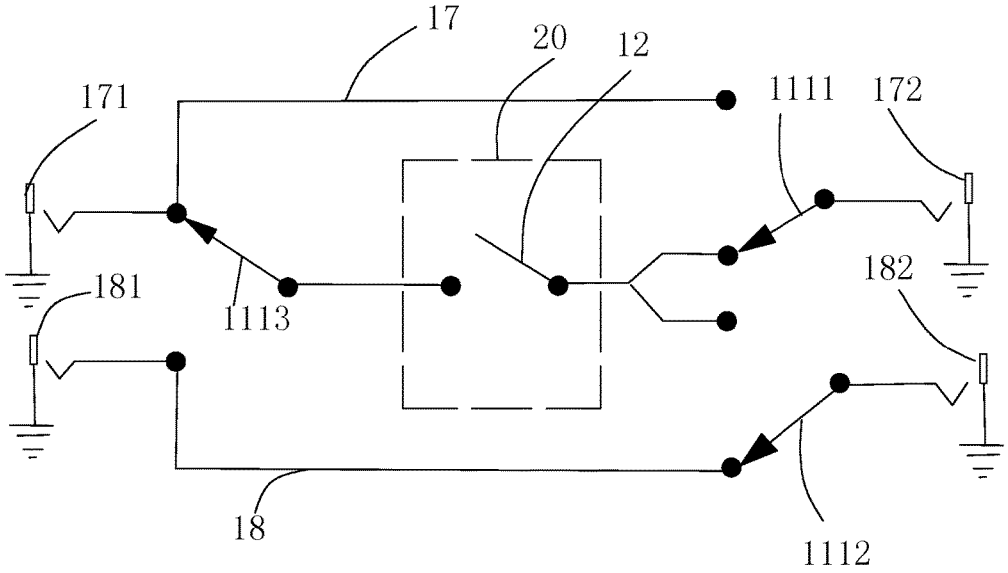
FIG. 11 shows a diagram of a circuit used in a sound effect adjusting unit of the sound effect adjusting device shown in FIG. 1.
Figure 1:
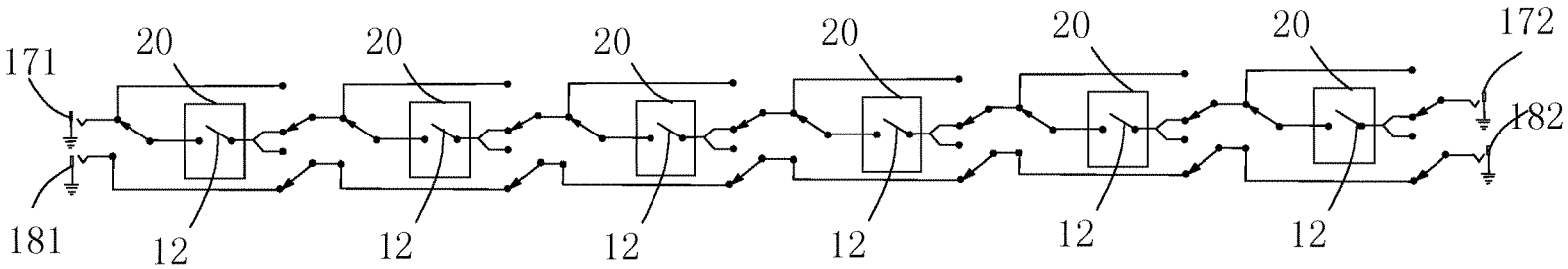

As shown in FIG. 1, a sound effect adjusting device 100 configured for adjusting sound effect of music instruments, such as guitar, piano and other stringed instruments, includes a pedal board 10 and at least one effect pedal 20. In the embodiment, there are six effect pedals 20.

As shown in FIG. 2 through FIG. 11, the pedal board 10 includes a first housing 13 having accommodating space 130, a three-way toggle switch 11 mounted in the first housing 13, a microswitch 12 mounted in the first housing 13 and electrically connected to the three-way toggle switch 11, and a mounting member 14 fixed on the first housing 13 for removable attaching to the effect pedal 20.

The first housing 13 includes a first base wall 131, a first top wall 132 opposite to the first base wall 131 and a first side wall 133 connected between the first base wall 131 and the first top wall 132. The first base wall 131, the first top wall 132 and the first side wall 133 corporately form the accommodating space 130. An output interface 171, an input interface 172, a return interface 181 and a send interface 182 are disposed on the first side wall 133. The pedal board 10 further includes a first wire 17 connected to the output interface 171 and a second wire 18 connected to the return interface 181. The first top wall 132 defines a second through hole 1320 adjacent to the mounting member 14.

The mounting member 14 is mounted on the first top wall 132 for removable attaching with the effect pedal 20. The mounting member 14 may include a U-shaped panel. The mounting member 14 includes a flat panel 141 and a side panel 142 extending upward from the edge of the flat panel 141. The side panel 142 is fixed to the top wall 132. The mounting member 14 further has a first projection 143 protruding toward the effect pedal 20 from the flat panel 141. A first through hole 1410 formed on the flat panel 141 is disposed adjacent to the first projection 143. In the embodiment, the flat panel 141 may be made by magnetic material. Alternatively, the mounting member 14 may include a magnet 144 disposed on the flat panel 141.

The mounting member 14 further includes a first pins assembly 15. The first pins assembly 15 is fixed into the first projection 143 for electrically coupled to the effect pedal 20 and removable attached to the effect pedal 20. The first pins assembly 15 includes a first positive pin 151, a first negative pin 152, a first signal input pin 153 and a first signal output pin 154. The pins 151, 152, 153 and 154 may be pogo pins. Each of the pogo pins has a first plunger received in the accommodating space 130, a first barrel fixed into the first projection 143 for electrically coupled to the effect pedal 20, and a first spring (not shown) received in the barrel and elastically supporting the first plunger.

The three-way toggle switch 11 includes a base body 111 located in the accommodating space 130 and an operating lever 110 connected to the base body 111 and extending out of the top wall 132 via the second through hole 1320 that is convenient for users to actuate the three-way toggle switch 11. The base body 111 includes a first contact blade 1111, a second contact blade 1112 and a third contact blade 1113. One end of the first contact blade 1111 is electrically connected with the input interface 172, one end of the second contact blade 1112 is electrically connected with the send interface 182, and one end of the third contact blade 1113 is electrically connected with the microswitch 12. The three-way toggle switch may be gang switch, which can be purchased from the market. The first, second and third contact blades 1111, 1112 and 1113 can move synchronously, and the first and second contact blades 1111, 1112 move in a direction and the third contact blade 1113 move in an opposite direction. The other end of the third contact blade 1113 can be selectively switched to electrically connect with the first wire 17 or the second wire 18. The other end of the first contact blade 1111 can be selectively switched to electrically connect with the effect pedal 20 or the first wire 17. The other end of the second contact blade 1112 can be selectively switched to electrically connect with the second wire or the effect pedal 20.

The microswitch 12 includes a fixing body 121, an elastic plate 122, a movable column 125, a reset spring 124 sleeved outside the movable column 125, a carrying plate 123 and a stop ring 126 located upon the reset spring 124 and sleeved outside the movable column 125. The carrying plate 123 is disposed above the elastic plate 122 and configured for carrying the movable column 125 and the pins 151, 152,153 and 154. The movable column 125 passes through the carrying plate 123. One end of the reset spring 126 abuts against the carrying plate 123 and another end thereof abuts against the stop ring 126. The elastic plate 122 has a fixing end 1220 fixed to the fixing body 121 and a flexible end contact with a bottom end of the movable column 125. A top end of the movable column 125 passes through the first through hole 1410 and extending out of the flat panel 141. The fixing body 121 is fixed on the first base wall 131. The fixing body 121, the elastic plate 122, the carrying plate 123, the reset spring 124 and the stop ring 126 are received in the accommodating space 130.

The effect pedal 20 includes a second housing 21, a PCB 23 received in the second housing 21, and a second pins assembly 22 electrically connected with the PCB 23. The second housing 21 includes a second top wall 213, a second side wall 212 and a second base wall 211 facing the pedal board 10. The second pins assembly 22 is fixed on the second base wall 211 of the second housing 21 toward the pedal board 10. The second pins assembly 22 includes a second positive pin 221, a second negative pin 222, a second signal input pin 223 and a second signal output pin 224. The second base wall 211 of the second housing 21 may be made by magnetic material. Alternatively, the second housing 21 may include a magnet disposed on the second base wall 211 and facing to the magnet 144 in the flat panel 141. The pins 221, 222, 223 and 224 may be pogo pins. Each of the pogo pins has a second plunger extending out of the second base wall 211, a second barrel received in the second housing 21 and a second spring received in the second barrel and elastically supporting the second plunger.

While assembled, the effect pedal 20 removable attaches to the mounting member 14. Specifically, the second base wall 211 of the effect pedal 20 attaches to the flat panel 141 by means of magnetic adsorption. The second plunger of the second positive pin 221 inserts into the first barrel of the first positive pin 151, the second plunger of the second negative pin 222 inserts into the first barrel of the first negative pin 153, the second plunger of the second signal input pin 223 inserts into the first barrel of the first signal input pin 153, and the second plunger of the second signal output pin 224 inserts into the first barrel of the first signal output pin 154. With such configuration, the effect pedal is electrically coupled to and removable attached to the pedal board. The effect pedal 20 presses the top end of the movable column 125, thus, the column 125 declines so that the microswitch 12 is OFF, and otherwise, the microswitch 12 is ON. User operates the operating lever 110 of the three-way toggle switch 11 so that another end of the first contact blade 1111 is switched to electrically connect with the second signal input pin 223 via the first signal input pin 153 and another end of the third contact blade 1113 is switched to electrically connect with the first wire 17. Therefore, the effect pedal 20 is electrically connected between the input interface 172 and the output interface 171 in series. The signal input into the effect pedal 20 via the input interface 172 and output the signal via the output interface 171. User operates the operating lever 110 of the three-way toggle switch 11 so that another end of the second contact blade 1112 is switched to electrically connect to the second signal input pin 223 via the first signal input pin 153, another end of the third contact blade 1113 is switched to electrically connect to the second wire 14, and thus, the effect pedal 20 is electrically connected between the send interface 182 and return interface 181 in series. While the effect pedal 20 is removed from pedal board 10, the microswitch 12 is ON, and the input interface 172 is electrically connected with the output interface 171 via the microswitch 12, or, the send interface 182 is electrically connected with the return interface 181 via the microswitch 12.

In this embodiment, the sound effect adjusting device 100 may includes a pedal board 10 and multiple effect pedals 20 removable attached onto the petal board 10, for example, six effect pedals 20. In the embodiment, the pedal board 10 has six mounting members 14 formed on the first top wall 132 with space. The pedal board 10 further includes six three-way toggle switches 11 and six microswitches 12. One effect pedal 20, one three-way toggle switch 11 and one microswitch 12 form a sound effect adjusting unit.

As shown in FIG. 12, While six effect pedals 20 attach to corresponding mounting members 14, users can operate the operating lever 110 of the three-way toggle switch 11 of each sound effect adjusting unit so that another end of the first contact blade 1111 is switched to electrically connect with the second signal input pin 223 via the first signal input pin 153, another end of the third contact blade 1113 is switched to electrically connect with the first wire 17, another end of the second contact blade 1112 is switched to electrically connect with the second wire 18, thus, six effect pedals can be electrically connected between the input interface 172 and the output interface 171 in series. And then, users need to change the amount of the effect pedals connected in series, for example, three effect pedals 20 electrically connected between the input interface 172 and the output interface 171 in series and the other three effect pedals 20 electrically connected between the send interface 182 and the return interface 181 is series, users can operate the operate lever 110 of the three-toggle switches of three sound effect adjusting unit so that another end of the first contact blade 1111 is switched to electrically connect with the first wire 17, another end of the second contact blade 1112 is switched to electrically connect with the second signal input pin 223 via the first signal input pin 153, another end of the third contact blade 1113 is synchronously switched to electrically connect with the second wire 18. With such configuration, three effect pedals 20 in the sound effect adjusting units are connected between the send interface 182 and the return interface 181 in series. Therefore, users can change amount of the effect pedals by operating the three-toggle switches according to their actual requirements, for example, two effect pedals 20 of them electrically connected between the input interface 172 and the output interface 171 in series and the other four effect pedals 20 electrically connected between the send interface 182 and the return interface 181 in series; or, one effect pedal 20 of them electrically connected between the input surface 172 and the output surface 171, and the other five effect pedals 20 electrically connected between the send surface 182 and the return surface 181 in series. With such configuration, the amount of the effect pedals connected between the input interface and the output interface or between the send interface and the return interface can be changed easily without removing the effect pedal or adding the effect pedal.

The description in more detail aims to help to understand the present invention, instead of limiting the present invention. According to the contents disclosed by the present invention, those skilled in the art shall understand that the present invention can be implemented even without some or all of these specific details. Under other circumstances, to avoid weakening the inventiveness of the present invention, the well-known circuits, methods, operation processes and the like will not be described in detail.

What is claimed is:

1. A sound effect adjusting device, comprising:

an effect pedal including a second pins assembly;

a pedal board including a first housing, a three-way toggle switch mounted in the first housing, a microswitch mounted in the first housing and electrically connected with the three-way toggle switch, and a mounting member mounted on the first housing to attach to the effect pedal;

wherein, the first housing includes an input interface, an output interface, a send interface and a return interface formed thereon;

the three-way toggle switch has a first contact blade electrically connected with the input interface, a second contact blade electrically connected with the send interface, and a third contact blade connected with the microswitch;

the mounting member has a first pins assembly electrically coupled to the second pins assembly and removably attached to the second pins assembly; wherein, while the effect pedal is assembled with the pedal board, the microswitch is off, and actuates the three-way toggle switch so that the effect pedal is connected between the input interface and the output interface in series, or, the effect pedal is connected between the send interface and the return interface in series.

2. The sound effect adjusting device according to claim 1, wherein, the first pins assembly includes a first positive pin, a first negative pin, a first signal input pin and a first signal output pin;

the second pins assembly includes a second positive pin, a second negative pin, a second signal input pin and a second signal output pin; wherein, the second positive pin inserts into the first positive pin, the second negative pin inserts into the first negative pin, the second signal input pin inserts into the first signal input pin, and the second signal output pin inserts into the first signal output pin.

3. The sound effect adjusting device according to claim 1, wherein, the first contact blade is switched to electrically connect with the second pins assembly via the first pins assembly, and the third contact blade is synchronously switched to electrically connect with the output interface so that the effect pedal is connected between the input interface and the output interface in series.

4. The sound effect adjusting device according to claim 1, wherein, the second contact blade is switched to electrically connect with the second pins assembly via the first pins assembly and the third contact blade is synchronously switched to electrically connect with the return interface so that the effect pedal is connected between the send interface and the return interface in series.

5. The sound effect adjusting device according to claim 2, wherein, the mounting member further includes a U-shaped panel having a flat panel attached to the effect pedal and a side panel extending upward from the edge of the flat panel; and the first pins assembly fixed on the flat panel.

6. The sound effect adjusting device according to claim 5, wherein, the flat panel has a first projection protruding toward the effect pedal for fixing the first pins assembly and a first through hole that is adjacent to the projection formed thereon.

7. The sound effect adjusting device according to claim 5, wherein, the flat panel is made by magnetic material.

8. The sound effect adjusting device according to claim 5, wherein, the mounting member further includes at least one magnet disposed on the flat panel.

9. The sound effect adjusting device according to claim 6, wherein, the microswitch includes a fixing body fixed on the first housing, an elastic plate having a fixing end fixed to the fixing body and a flexible end, a movable column movably contacted with the flexible end, a reset spring sleeved outside the movable column, a carrying plate located above the fixing body for carrying the reset spring, and a stop ring located upon the reset spring and sleeved outside the movable column, wherein, the movable column movably passes through the carrying plate and extending out of the flat panel via the first through hole.

10. A pedal hoard, assembled with a pedal effect, comprising, a first housing, includes an input interface, an output interface, a send interface and a return interface formed thereon;

a three-way toggle switch mounted in the first housing, the three-way toggle switch having a first contact blade electrically connected with the input interface, second contact blade electrically connected with the send interface, and a third contact blade;

a microswitch mounted in the first housing and connected with the third contact blade of the three-way toggle switch; and a mounting member mounted on the first housing to attach to the effect pedal, the mounting member has a first pins assembly electrically coupled to the effect pedal and removably attached to the effect pedal; wherein, while the effect pedal is assembled with the pedal board, the microswitch is off, and operates the three-way toggle switch so that the effect pedal is connected between the input interface and the output interface in series, or, the effect pedal is connected between the send interface and the return interface in series.

11. The pedal board according to claim 10, wherein, the first contact blade is switched to electrically connect with the effect pedal via the first pins assembly and the third contact blade is synchronously switched to electrically connect with the output interface so that the effect pedal is connected between the input interface and the output interface in series.

12. The pedal board according to claim 10, wherein, the second contact blade is switched to electrically connect with the effect pedal via the first pins assembly and the third contact blade is synchronously switched to electrically connect with the return interface so that the effect pedal is connected between the send interface and the return interface in series.

13. The sound effect adjusting device according to claim 10, wherein, the mounting member further includes a U-Shaped panel having a flat panel attached to the effect pedal and a side panel extending upward from the edge of the flat panel; and the first pins assembly fixed on the flat panel.

14. The sound effect adjusting device according to claim 13, wherein, the flat panel has a first projection protruding toward the effect pedal for fixing the first pins assembly and a first through hole that is adjacent to the projection formed thereon.

15. The sound effect adjusting device according to claim 14, wherein, the flat panel is made by magnetic material.

16. The sound effect adjusting device according to claim 14, wherein, the mounting member further includes at least one magnet disposed on the flat panel.

17. The sound effect adjusting device according to claim 14, wherein, the microswitch includes a fixing body fixed on the first housing, an elastic plate having a fixing end fixed to the fixing body and a flexible end, a movable column movably contacted with the flexible end, a reset spring sleeved outside the movable column, a carrying plate located above the fixing body for carrying the reset spring, and a stop ring located upon the reset spring and sleeved outside the movable column, wherein, the movable column movably passes through the carrying plate and extending out of the flat panel via the first through hole.

* * * * *